US009862472B2

(12) United States Patent
Sugiyama et al.

(10) Patent No.: US 9,862,472 B2
(45) Date of Patent: Jan. 9, 2018

(54) OUTBOARD MOTOR

(71) Applicant: SUZUKI MOTOR CORPORATION, Hamamatsu-shi (JP)

(72) Inventors: Shuichi Sugiyama, Hamamatsu (JP); Keisuke Daikoku, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 84 days.

(21) Appl. No.: 14/939,082

(22) Filed: Nov. 12, 2015

(65) Prior Publication Data

US 2016/0137280 A1 May 19, 2016

(30) Foreign Application Priority Data

Nov. 14, 2014 (JP) ..... 2014-231820

(51) Int. Cl.

| | |
|---|---|
| ***B63H 20/14*** | (2006.01) |
| ***B63H 20/16*** | (2006.01) |
| ***B63H 23/30*** | (2006.01) |
| ***B63H 20/20*** | (2006.01) |
| *B63H 20/32* | (2006.01) |
| *B63H 5/10* | (2006.01) |

(52) U.S. Cl.

CPC ..... *B63H 23/30* (2013.01); *B63H 20/14* (2013.01); *B63H 20/20* (2013.01); *B63H 2005/106* (2013.01); *B63H 2020/323* (2013.01)

(58) Field of Classification Search

CPC ..... B63H 20/14; B63H 20/16; B63H 20/18; B63H 2020/323; B63H 23/04; B63H 23/06; B63H 23/08; B63H 23/30; B63H 5/10; B63H 2005/106; B63H 21/28

USPC ..... 440/75

See application file for complete search history.

(56) References Cited

U.S. PATENT DOCUMENTS

| | | | | |
|---|---|---|---|---|
| 2,739,560 | A * | 3/1956 | Armstrong | B63H 21/265 192/51 |
| 3,428,018 | A * | 2/1969 | Ellzey | B63H 20/002 440/53 |
| 4,747,795 | A * | 5/1988 | Kawamura | B63H 21/28 440/75 |
| 5,403,218 | A | 4/1995 | Onoe et al. | |
| 9,260,170 | B2 * | 2/2016 | Kubo | B63H 20/14 |
| 9,475,562 | B2 * | 10/2016 | Sugiyama | B63H 23/30 |

FOREIGN PATENT DOCUMENTS

| | | |
|---|---|---|
| JP | 06-221383 A | 8/1994 |
| JP | 2008-195200 A | 8/2008 |

* cited by examiner

*Primary Examiner* — Ajay Vasudeva

(74) *Attorney, Agent, or Firm* — Troutman Sanders LLP

(57) ABSTRACT

The outboard motor includes a lower unit that rotatably supports a propeller shaft installed with propellers, and a shift unit that switches a shift position. The lower unit is provided with an upwardly opened shift unit storage chamber and a lid member that covers the upper side of the shift unit storage chamber. The shift unit has a dog clutch that switches the shift position by reciprocating in parallel with the drive shaft, a shift fork member that reciprocates the dog clutch in parallel with the drive shaft, and an actuator that reciprocates the shift fork member in parallel with the drive shaft. The actuator is supported by the lid member.

4 Claims, 9 Drawing Sheets

OUTBOARD MOTOR

CROSS-REFERENCE TO RELATED APPLICATIONS

This application is based upon and claims the benefit of priority of the prior Japanese Patent Application No. 2014-231820, filed on Nov. 14, 2014, the entire contents of which are incorporated herein by reference.

BACKGROUND OF THE INVENTION

Field of the Invention

This invention relates to an outboard motor, and more particularly, to an outboard motor in which a shift unit for switching a shift position is provided in the middle of a drive shaft that transmits rotational power from an engine to a propeller shaft.

Description of the Related Art

A typical outboard motor has a shift unit that switches a shift position. In Patent Document 1, there is disclosed an outboard motor having a shift unit arranged across a propulsion unit casing and an upper casing arranged thereover. In addition, in Patent Document 2, there is disclosed an outboard motor having a propulsion unit casing where a clutch body of the shift unit is arranged, and an actuator for driving the clutch body arranged in a casing disposed thereover.

Meanwhile, there is a demand of improving workability for assembling the shift unit. However, Patent Documents 1 and 2 described above fail to disclose any configuration of improving workability for assembling the shift unit. In order to assemble the shift unit to the outboard motor, it is necessary to sequentially assemble members of the shift unit to the casing of the outboard motor with predetermined sequence and accuracy. In addition, in Patent Document 2, the clutch body and the actuator for driving the clutch body are arranged in different casings. In this configuration, high assembly accuracy is required when the casing of the clutch body and the casing of the actuator are coupled.

CITATION LIST

Patent Documents

[Patent Document 1] Japanese Laid-open Patent Publication No. 06-221383

[Patent Document 2] Japanese Laid-open Patent Publication No. 2008-195200

SUMMARY OF THE INVENTION

In view of the aforementioned problems, it is therefore an object of the present invention to improve workability in assembling the shift unit of the outboard motor.

According to an aspect of the invention, there is provided an outboard motor including: an upper unit where an engine is housed; a lower unit that rotatably supports a propeller shaft where a propeller is installed; a middle unit provided between the upper and lower units to house a part of a drive shaft that transmits rotational power from the engine to the propeller shaft; and a shift unit that switches a shift position, wherein the lower unit is provided with an upwardly opened shift unit storage chamber and a lid member that blocks an upper side of the shift unit storage chamber, the shift unit has a clutch body that switches the shift position by reciprocating in parallel with the drive shaft, a shift fork member engaged with the clutch body to reciprocate the clutch body in parallel with the drive shaft, and an actuator that reciprocates the shift fork member in parallel with the drive shaft, the shift unit is housed in the shift unit storage chamber, and the actuator is supported by the lid member.

In the outboard motor described above, the lid member may be provided with a guide member that guides the shift fork member reciprocatingly in parallel with an axial line of the drive shaft.

In the outboard motor described above, the actuator may be a linear motion type having a motor that generates rotational power, and a ball screw mechanism that has a ball screw nut and a screw shaft and converts rotational power generated from the motor into a rectilinear motion, and the shift fork member may be connected by using the screw shaft and reciprocates the clutch in parallel with the drive shaft by a rectilinear motion of the screw shaft.

In the outboard motor described above, the lid member may be provided with a bearing that rotatably supports the drive shaft.

DETAILED DESCRIPTION OF THE PREFERRED EMBODIMENTS

A description will now be made for embodiments of the present invention with reference to the accompanying drawings. The embodiments of the present invention relate to an outboard motor having a contra-rotating propeller. It is noted that, in each of the drawings, the arrow Fr denotes a front side of the outboard motor, the arrow Rr denotes a rear side, the arrow R denotes a right side, and the arrow L denotes a left side, the arrow Up denotes an upper side, and the arrow Dn denotes a lower side.

<Entire Configuration of Outboard Motor>

Figure 1:
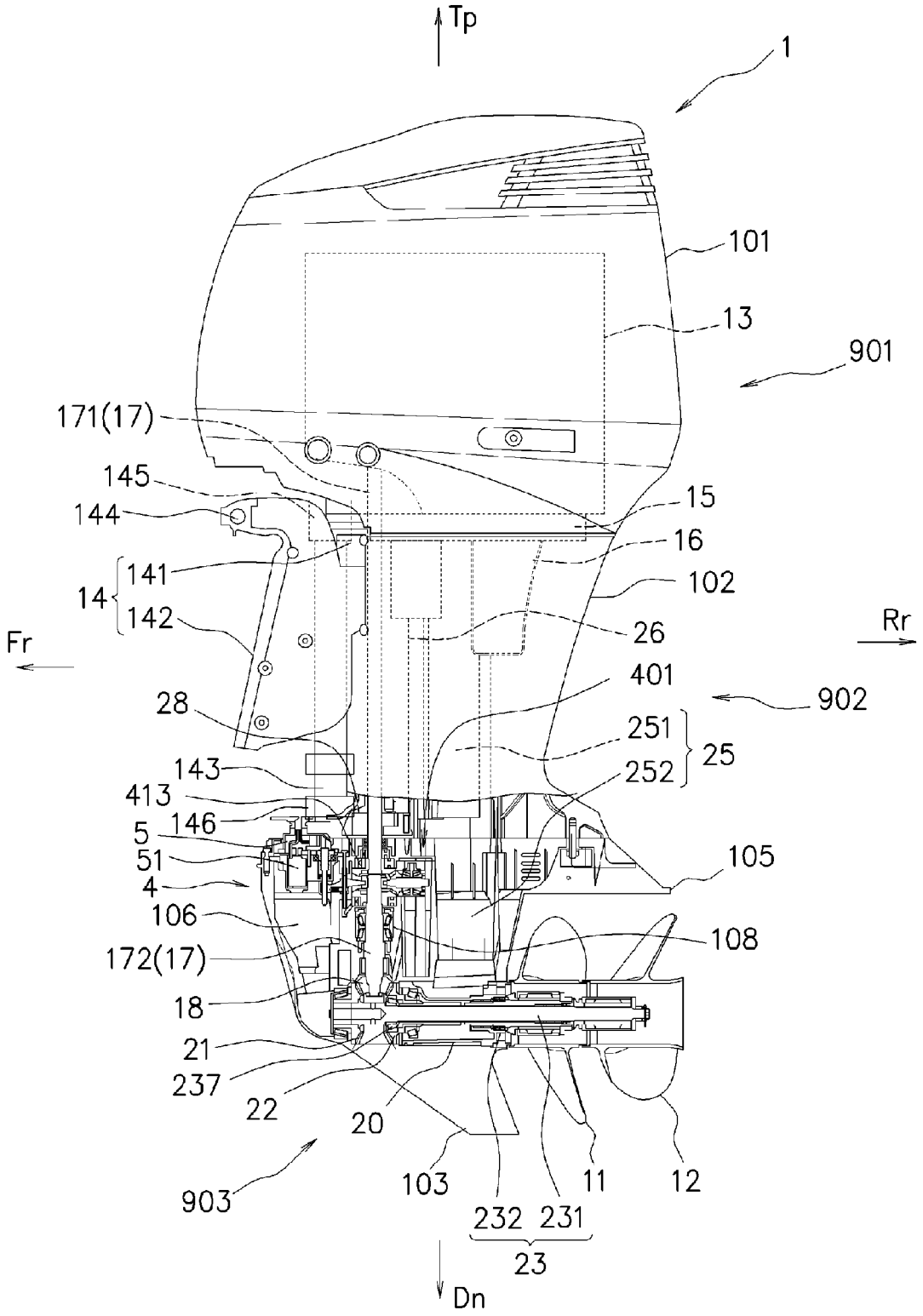
FIG. 1 is a partially cross-sectional view schematically illustrating an exemplary configuration of an outboard motor.
Figure 2:
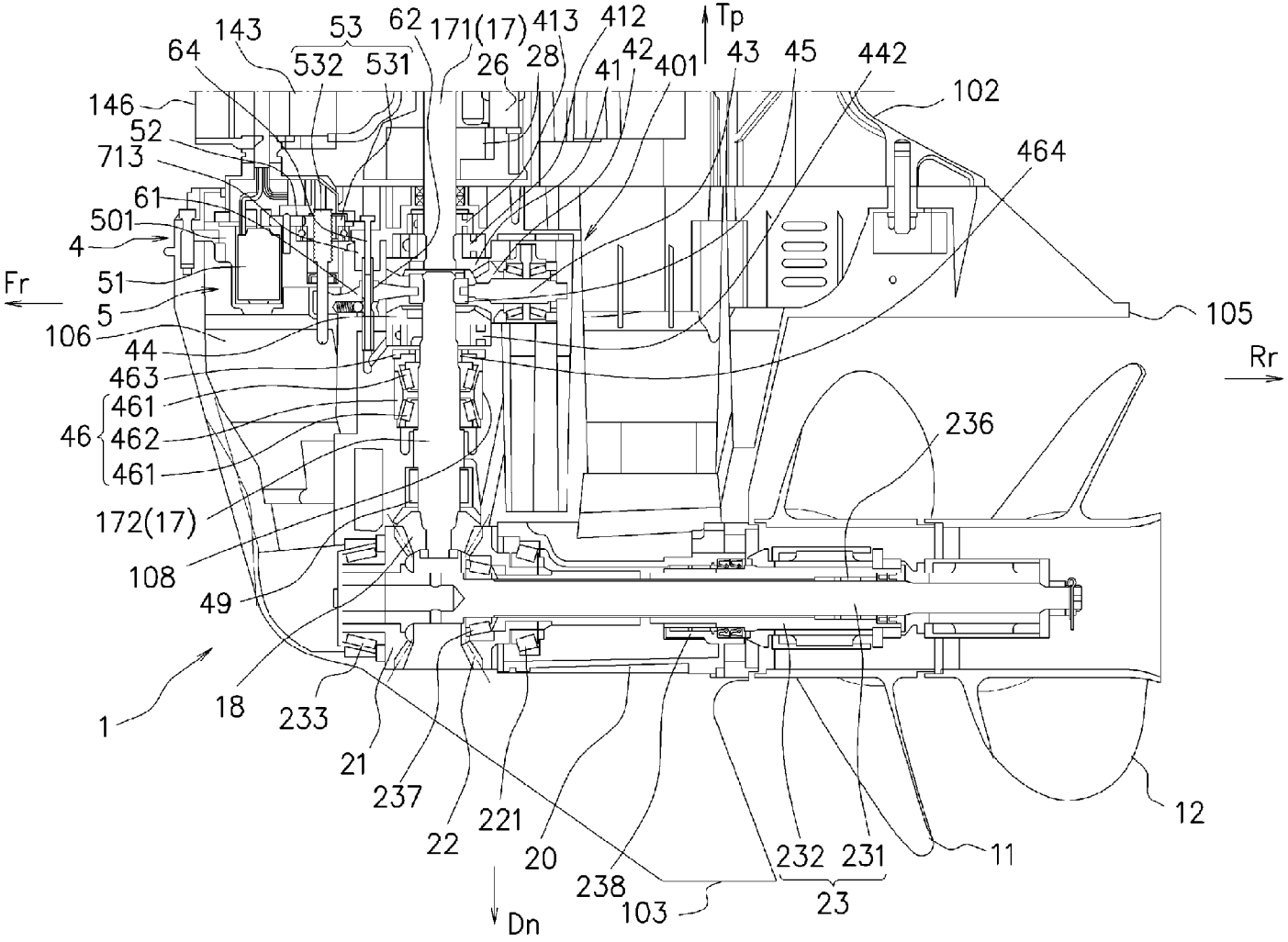
FIG. 2 is an enlarged cross-sectional view illustrating an exemplary internal configuration of a lower portion of the outboard motor.

An exemplary entire configuration of the outboard motor 1 will be described with reference to FIGS. 1 and 2. FIG. 1 is a partially cross-sectional view schematically illustrating an exemplary configuration of the outboard motor 1. FIG. 2 is an enlarged cross-sectional view illustrating an exemplary internal configuration of the lower portion of the outboard motor 1. As illustrated in FIG. 1, the outboard motor 1 has an upper unit 901 provided in the uppermost side, a lower unit 903 provided in a lowermost side, a middle unit 902 provided between the upper and lower units 901 and 903. The upper unit 901 has an engine cover 101 as a casing. In addition, an engine 13 (internal combustion engine) serving as a driving power source of the outboard motor 1 is mounted inside the engine cover 101.

The lower unit 903 has a lower unit housing 103 as a casing. Inside the lower unit housing 103, a propeller shaft 23 is rotatably housed. The propeller shaft 23 transmits rotational power to each of front and rear propellers 11 and 12. The front and rear propellers 11 and 12 for generating a thrust force are coaxially arranged side by side along the front-rear direction in rear of the lower unit housing 103. In addition, the front and rear propellers 11 and 12 constitute a contra-rotating propeller rotating reversely to each other. In the embodiments of this invention, it is assumed that, as seen from the rear side, the front propeller 11 rotates in the right-handed direction (i.e., clockwise), and the rear propeller 12 rotates in the left-handed direction (i.e., counterclockwise) to propel the outboard motor 1 forward.

The middle unit 902 has a drive shaft housing 102 as a casing. Inside the drive shaft housing 102, a drive shaft 17 that transmits rotational power of the engine 13 to the propeller shaft 23 is housed partially. A bracket unit 14 for installing the outboard motor 1 to a ship body is provided in front of the drive shaft housing 102. The outboard motor 1 is installed in a part of the ship such as a stem plate by using this bracket unit 14. In addition, the engine cover 101, the drive shaft housing 102, and the lower unit housing 103 constitute an exterior (frame) of the main body of the outboard motor 1.

A configuration of a power transmission system of the outboard motor 1 will be described. As illustrated in FIG. 1, the outboard motor 1 has an engine 13 (internal combustion engine), a drive shaft 17, a shift unit 4, and a propeller shaft 23. The engine 13 serves as a driving power source of the outboard motor 1. The drive shaft 17 transmits, to the propeller shaft 23, the rotational power output from the engine 13. The drive shaft 17 includes an upper drive shaft 171 as a first drive shaft and a lower drive shaft 172 as a second drive shaft. The upper and lower drive shafts 171 and 172 are separate members coaxially arranged side by side along a vertical direction. The shift unit 4 connects/disconnects the rotational power and performs switching of the rotational direction (i.e., switching of the shift position) between the upper and lower drive shafts 171 and 172 constituting the drive shaft 17. The propeller shaft 23 includes an inner shaft 231 rotating in synchronization with the front propeller 11 and an outer shaft 232 rotating in synchronization with the rear propeller 12. The outer shaft 232 is a cavity shaft. The inner shaft 231 is arranged coaxially with the outer shaft 232 inside the outer shaft 232. The rotational power output from the engine 13 is transmitted to each of the front and rear propellers 11 and 12 via the upper drive shaft 171, the shift unit 4, the lower drive shaft 172, and the propeller shaft 23 (inner and outer shafts 231 and 232).

As illustrated in FIG. 1, inside the engine cover 101, the engine 13 is mounted while it is supported by the upper side of the engine holder 15. For example, a vertical water-cooled engine is employed as the engine 13. In this case, the engine 13 is formed by assembling a cylinder head, a cylinder block, a crank casing, and the like. In addition, in the engine 13, the crank casing is located in the frontmost side, the cylinder block is located in rear of the crank casing, the cylinder head is located in the rearmost side, and the axial line of the crank shaft is arranged in parallel with the vertical direction. An oil pan 16 is arranged in rear of the drive shaft 17 under the engine holder 15.

Inside the drive shaft housing 102, an upper drive shaft 171 as a part of the drive shaft 17 is rotatably housed to extend along a vertical direction (such that the axial line is upright). The upper end of the upper drive shaft 171 is connected to the crank shaft of the engine 13. The lower end of the upper drive shaft 171 is connected to the shift unit 4. In addition, the upper drive shaft 171 transmits the rotational power output from the engine 13 to the shift unit 4. Furthermore, inside the drive shaft housing 102, a water pump 28 is arranged. The water pump 28 is actuated by rotation of the upper drive shaft 171 to receive a coolant from the outside of the outboard motor 1 and supply the coolant to the engine 13.

As illustrated in FIG. 2, the lower unit housing 103 as a casing of the lower unit 903 is provided under the drive shaft housing 102 as a casing of the middle unit 902. Inside the lower unit housing 103, the shift unit 4, the lower drive shaft 172, the bearing housing 20, a pair of follower gears including the front and rear gears 21 and 22, and the propeller shaft 23 (including inner and outer shafts 231 and 232) are arranged. It is noted that a shift unit storage chamber 106 is formed in the vicinity of the upper side inside the lower unit housing 103 (in the vicinity of a coupling portion of the drive shaft housing 102). The shift unit storage chamber 106 is an upwardly opened space (in the drive shaft housing 102 side). In addition, the shift unit 4 is housed in the shift unit storage chamber 106. A configuration of the shift unit 4 will be described below in more detail.

The lower drive shaft 172 is arranged coaxially in series with the upper drive shaft 171 under the upper drive shaft 171. The axial line of the lower drive shaft 172 is in parallel with the vertical direction. In addition, the lower drive shaft 172 is rotatably supported by a pair of bearings 46 and 49. As the upper bearing 46 out of a pair of bearings 46 and 49, a double-row tapered roller bearing is employed in order to endure a radial load and both upper and lower thrust loads. In this embodiment, a tapered roller bearing having a single outer race 462 and a pair of tapered roller rows 461 is employed as the double-row tapered roller bearing. In addition, the bearing 46 is held in an outer circumference of the lower drive shaft 172 by the ring nut 464 and is housed in a bearing storage chamber 108 provided in the lower unit housing 103. Furthermore, as the lower bearing 49, a radial bearing such as a cylindrical roller bearing or a needle roller bearing is employed. It is noted that this bearing 46 may be formed by arranging a pair of single-row tapered roller bearings oppositely and in series and housing this pair of single-row tapered roller bearings in a single cylindrical member (a member corresponding to the outer race 462).

The upper end of the lower drive shaft 172 is connected to the shift unit 4. In addition, the lower drive shaft 172 extends vertically downward from the shift unit 4. The lower end of the lower drive shaft 172 is provided with a pinion gear 18 serving as a drive gear such that it rotates in synchronization with the lower drive shaft 172. As the pinion gear 18, a bevel gear may be employed. In addition, the pinion gear 18 is coupled to the lower end of the lower drive shaft 172 in a spline-like manner.

The bearing housing 20 is a member for rotatably supporting the propeller shaft 23 and the rear gear 22. The bearing housing 20 is a cylindrical member penetrating in an axial direction and has an axial line arranged in parallel with the front-rear direction. The bearing housing 20 is inserted into the inside of the lower unit housing 103 from the rear side and is detachably fixed to the lower unit housing 103 using a bolt and the like. In addition, the bearing housing 20 rotatably supports the outer shaft 232 and the rear gear 22 using the bearings 221 and 238.

The outer shaft 232 is a cavity shaft and has an axial line arranged in parallel with the front-rear direction. The middle of the longitudinal direction (front-rear direction) of the outer shaft 232 is inserted into the inside of the bearing housing 20 so that the outer shaft 232 is supported by the bearings 221 and 238 rotatably with respect to the bearing housing 20. It is noted that an antifriction bearing such as a needle roller bearing or a cylindrical roller bearing is employed in the bearings 221 and 238 that rotatably support the outer shaft 232. The front end of the outer shaft 232 is fixed by a nut or the like so that the rear gear 22 can rotate in synchronization. The front propeller 11 is provided in the rear end of the outer shaft 232 so as to rotate in synchronization using a shear pin (not shown) and the like.

The middle of the longitudinal direction of the inner shaft 231 is inserted into the inside of the outer shaft 232 so that the inner shaft 231 is supported by the bearings 236 and 237 rotatably with respect to the outer shaft 232 and the rear gear 22. As the bearing 236 provided in the outer shaft 232, for example, an antifriction bearing such as a needle roller bearing is employed. As the bearing 237 provided in the rear gear 22, a tapered roller bearing and the like may be employed. In this configuration, the inner and outer shafts 231 and 232 can rotate independently from each other. The front end of the inner shaft 231 protrudes forward from the front end of the outer shaft 232 so as to be located in front of the lower drive shaft 172 as seen from the side view. In addition, the front gear 21 is engaged with the front end of the inner shaft 231 so as to rotate in synchronization. The rear end of the inner shaft 231 protrudes backward from the rear end of the outer shaft 232. Furthermore, the rear propeller 12 is provided in the rear end of the inner shaft 231 so as to rotate in synchronization using a shear pin (not shown) and the like.

As both the front and rear gears 21 and 22 serving as a pair of follower gears, bevel gears are employed. Each of the front and rear gears 21 and 22 meshes with the pinion gear 18 serving as a drive gear at all times so as to receive rotational power from the pinion gear 18 and rotate. The front gear 21 is arranged in a lower front side of the pinion gear 18 so as to be supported rotatably inside the lower unit housing 103 using a bearing 233 (such as a tapered roller bearing). The rear gear 22 is arranged in the lower rear side from the pinion gear 18 so as to be supported rotatably in the front side of the bearing housing 20 using a bearing 221 (for example, a combination of a thrust needle roller bearing or a thrust cylindrical roller bearing and a cylindrical roller bearing). The front and rear gears 21 and 22 are provided side by side coaxially along the front-rear direction such that its rotational center axis is in parallel with the front-rear direction. As described above, the front gear 21 is engaged with the front end of the inner shaft 231 so that the front gear 21 and the inner shaft 231 rotate in synchronization. Meanwhile, the rear gear 22 is provided in the front end of the outer shaft 232 so that the rear gear 22 and the outer shaft 232 rotate in synchronization. In addition, the front and rear gears 21 and 22 rotate reversely to each other by the rotational power transmitted from the lower drive shaft 172.

In this manner, the rotational power output from the engine 13 is transmitted to the front and rear gears 21 and 22 as a pair of follower gears via the upper drive shaft 171, the shift unit 4, the lower drive shaft 172, and the pinion gear 18. In addition, the rotational power transmitted to the front gear 21 is transmitted to the rear propeller 12 via the inner shaft 231. Furthermore, the rotational power transmitted to the rear gear 22 is transmitted to the front propeller 11 via the outer shaft 232. As a result, the front and rear propellers 11 and 12 constitute a contra-rotating propeller so as to rotate reversely to each other.

It is noted that the bearing housing 20, the outer shaft 232, the inner shaft 231, and the rear gear 22 are modularized. In addition, they are detachably assembled to the lower unit housing 103 using a bolt and the like while they are modularized.

As illustrated in FIG. 1, the bracket unit 14 is provided in front of the casing of the outboard motor (in particular, in front of the drive shaft housing 102). The bracket unit 14 has a swivel bracket 141 and a transom bracket 142. The swivel bracket 141 is connected to the front side of the casing of the outboard motor 1 by interposing a pilot shaft 143 rotatably in a horizontal direction (movable in the left-right direction). The pilot shaft 143 is a shaft serving as a steering center of the outboard motor 1. The pilot shaft 143 is fixed to the front side of the casing of the outboard motor 1 such that its axial line is in parallel with the vertical direction (upright direction). For example, the upper end of the pilot shaft 143 is fixed to the casing of the outboard motor 1 by using the upper mount bracket 145, and the lower end is fixed to the casing of the outboard motor 1 by using the lower mount bracket 146. It is noted that the pilot shaft 143 has a pipe-like shape penetrating in an axial direction.

The transom bracket 142 is connected to the swivel bracket 141 by using a tilt shaft 144 rotatably in a pitching direction (movable in a vertical direction). The tilt shaft 144 is fixed to the swivel bracket 141 such that its axial line is in parallel with the left-right direction. In addition, the transom bracket 142 is provided with a clamp or the like for installation to a ship stem plate and the like. Furthermore, the outboard motor 1 is installed in a ship stem plate or the like by using the transom bracket 142 of the bracket unit 14. If the bracket unit 14 has such a configuration, the outboard motor 1 can rotate horizontally with respect to the pilot shaft 143 and vertically with respect to the tilt shaft 144 while being installed in a ship stem plate and the like.

It is noted that the upper mount bracket 145 is provided with a steering bracket (not shown). A steering handle (not shown) is connected to the steering bracket. A ship operator controls steering of the outboard motor 1 by manipulating the steering handle. In addition, the outboard motor 1 is provided with a trim control unit (not shown). The trim unit can rotate the outboard motor 1 in a pitching direction by using a hydraulic pressure and the like. Furthermore, a ship operator performs tilt or trim control of the outboard motor 1 by manipulating a trim control unit.

In addition, the outboard motor 1 is provided with an exhaust passage 25 as a passage for guiding an exhaust gas of the engine 13 to the outside of the outboard motor 1 and a coolant passage 26 that guides a coolant to the engine 13. The exhaust passage 25 has an upper exhaust passage 251 and a lower exhaust passage 252. The upper exhaust passage 251 is formed in rear of the upper drive shaft 171 inside the drive shaft housing 102. The lower exhaust passage 252 is formed in rear of the shift unit 4 inside the lower unit housing 103. In addition, the exhaust passage 25 vertically extends inside the drive shaft housing 102 and the lower unit housing 103. The upper exhaust passage 251 communicates with an exhaust port (not shown) of the engine 13. The lower exhaust passage 252 communicates with, for example, an exhaust port (not shown) formed on a bottom face of a cavitation plate 105. Furthermore, as the lower unit housing 103 is installed in the drive shaft housing 102, the upper and lower exhaust passages 251 and 252 communicate with each other in an integrated manner. For this reason, the exhaust gas of the engine 13 is discharged to the outside of the outboard motor 1 through the exhaust port via the upper and lower exhaust passages 251 and 252.

<Configuration of Shift Unit>

Figure 3:
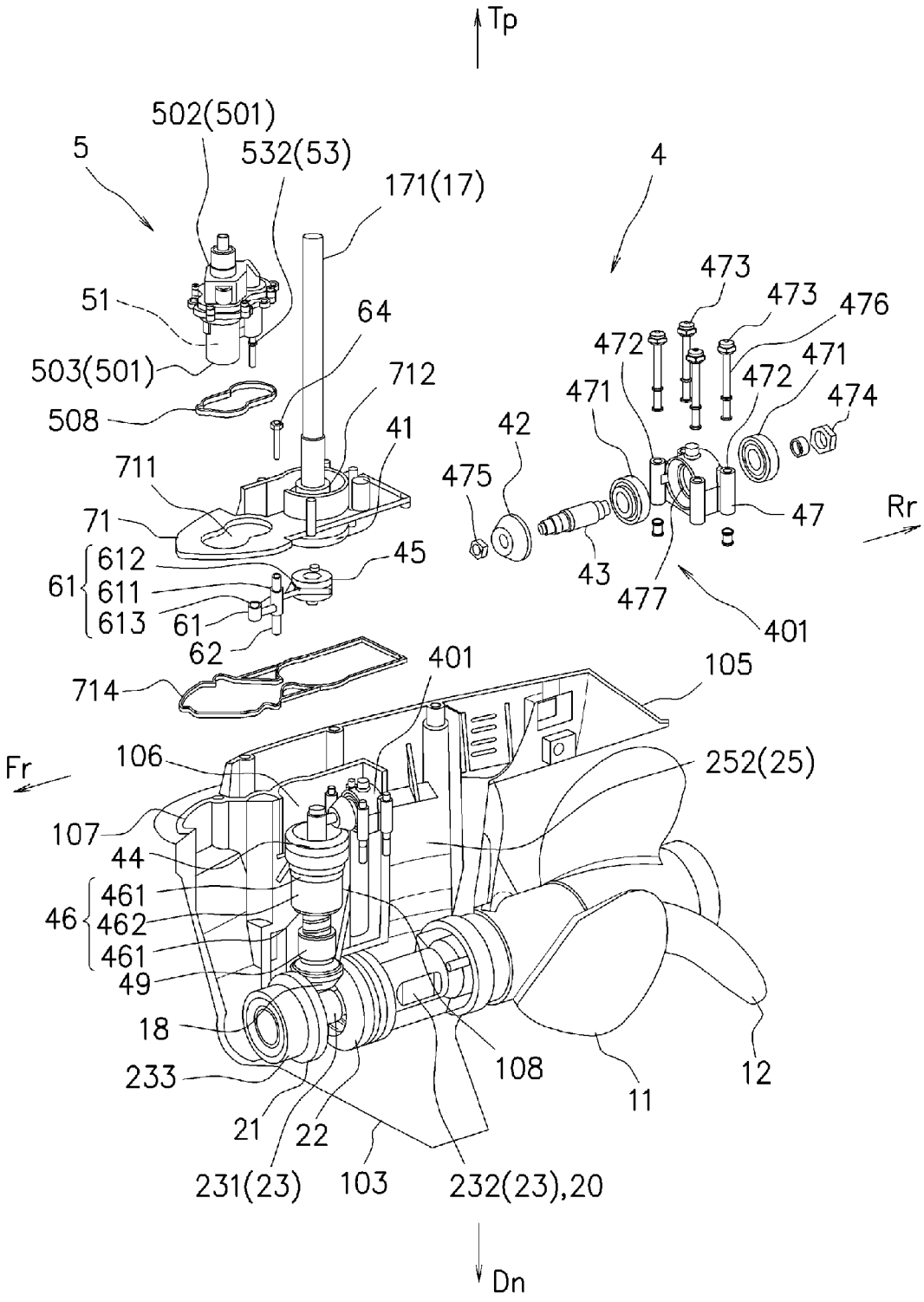
FIG. 3 is an exploded perspective view schematically illustrating an exemplary configuration of a shift unit.
Figure 4:
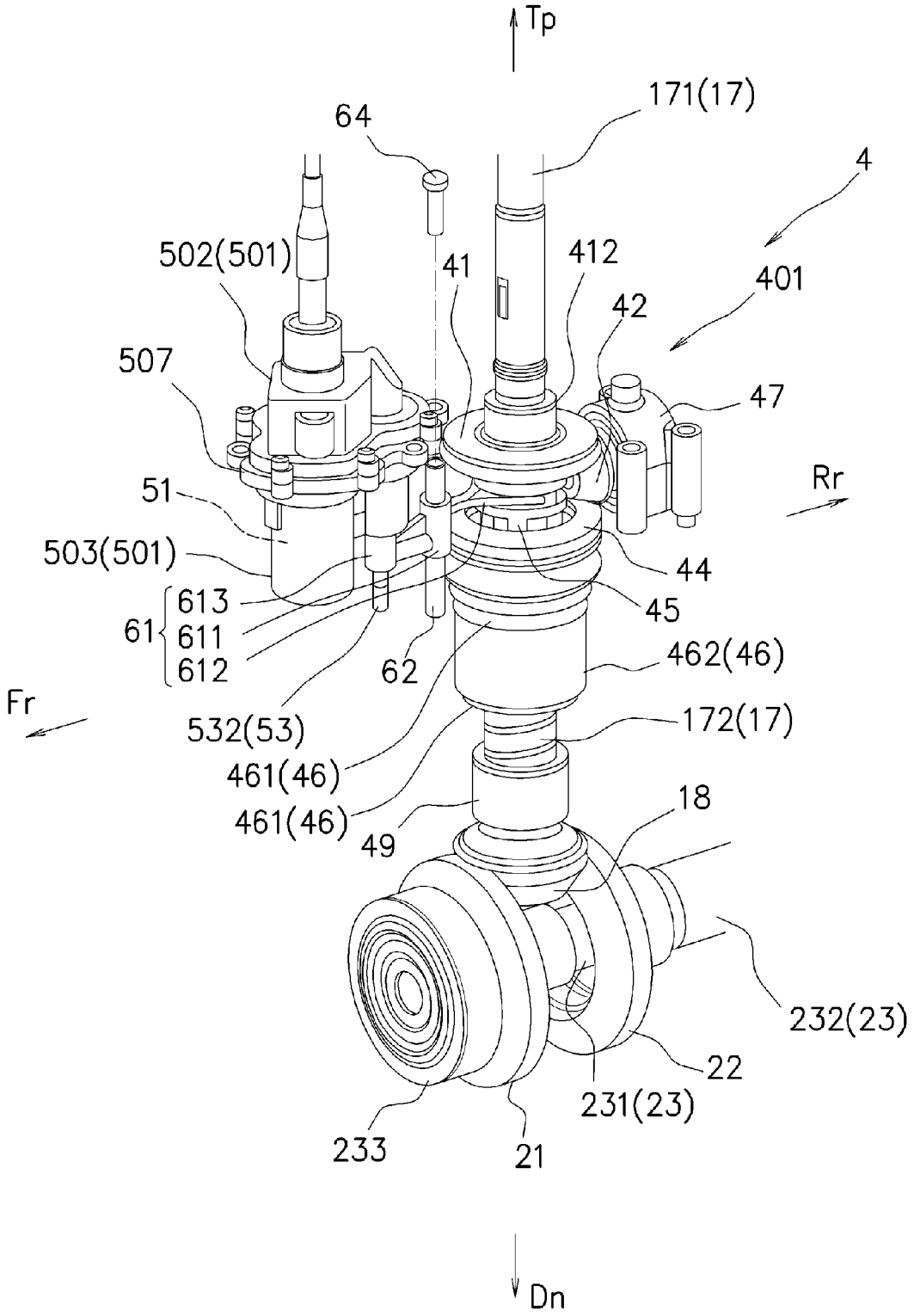
FIG. 4 is a perspective view schematically illustrating an exemplary configuration of the shift unit.
Figure 5:
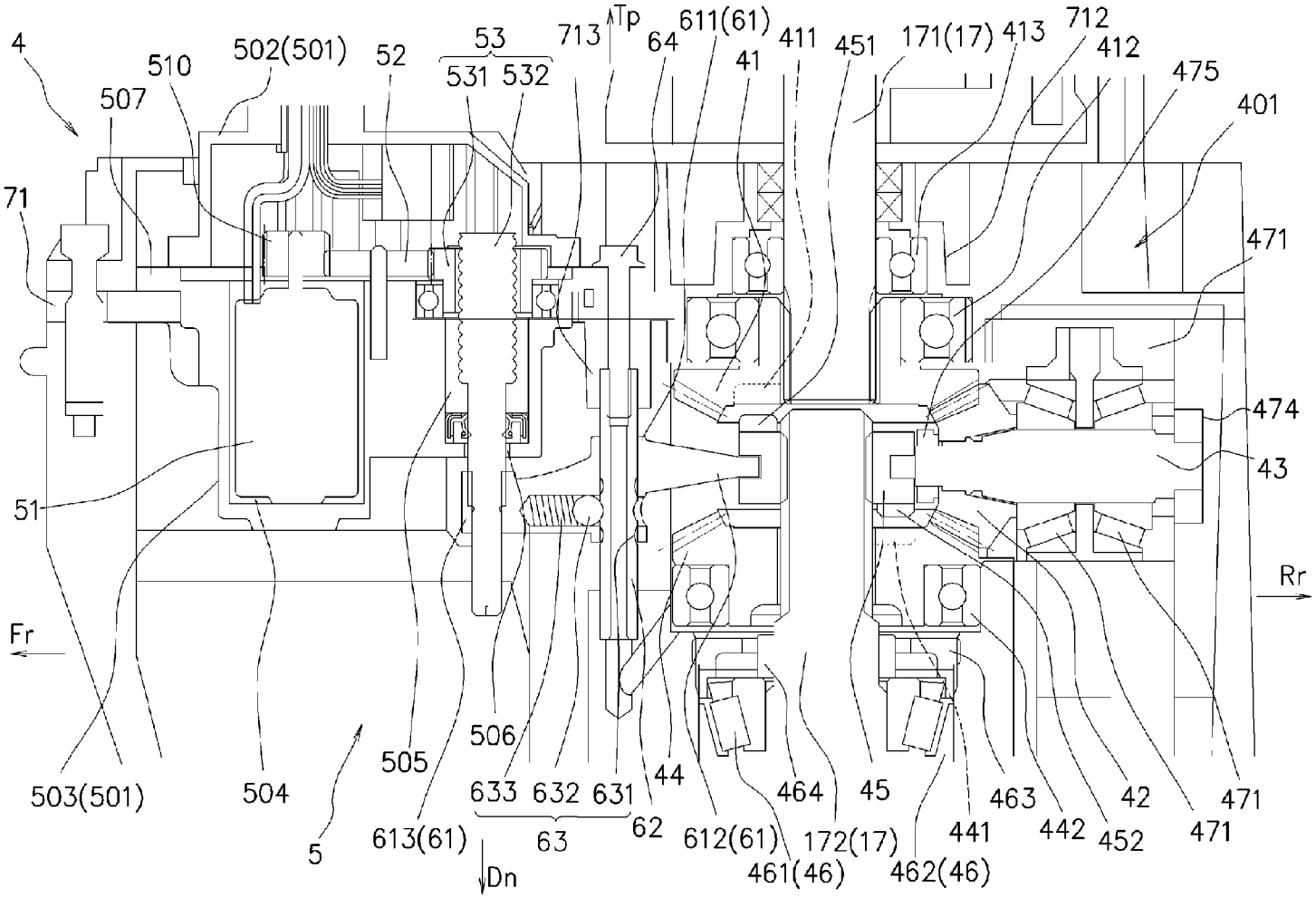
FIG. 5 is a cross-sectional view illustrating an exemplary configuration of the shift unit.
Figure 6:
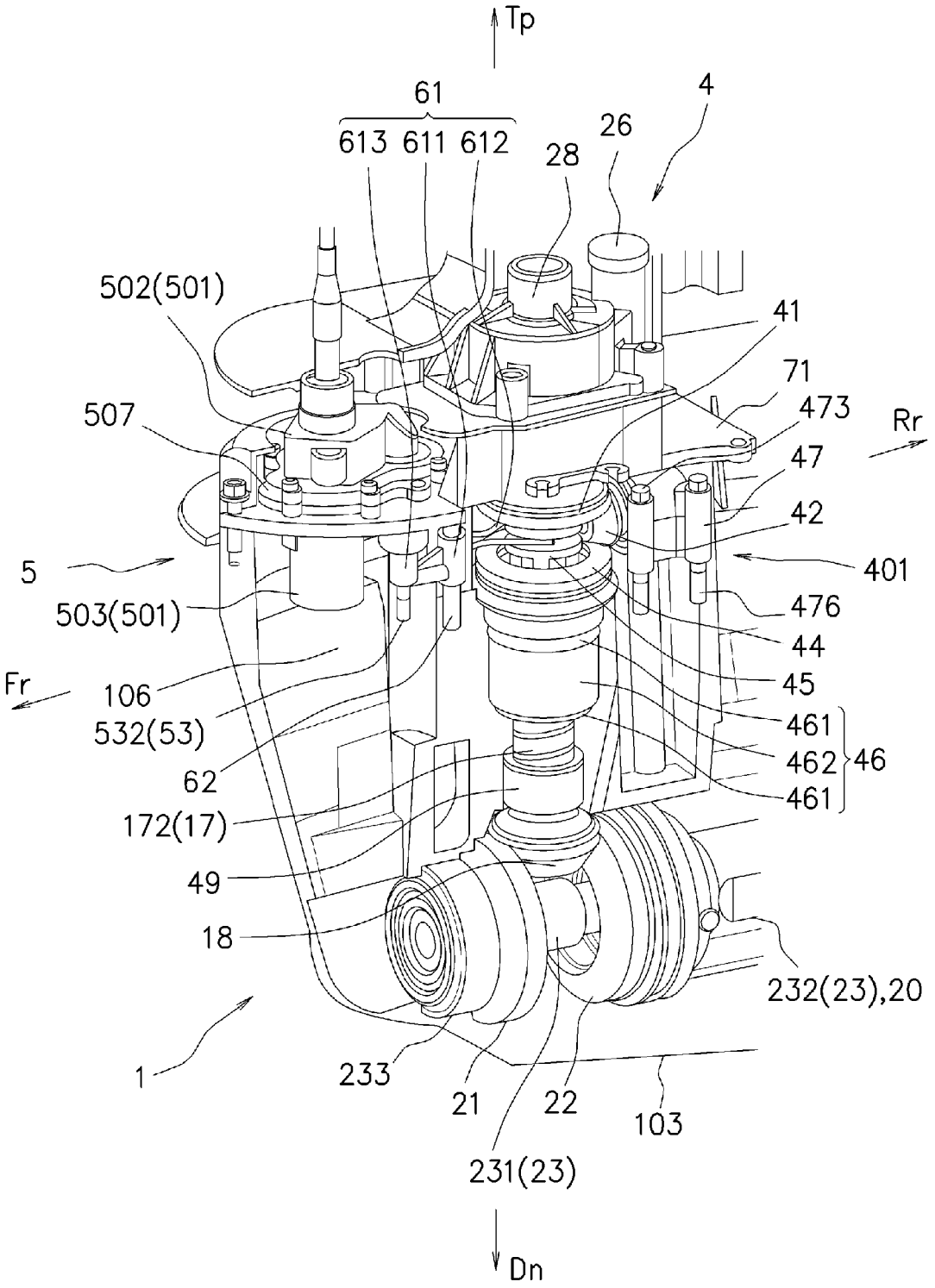
FIG. 6 is a cross-sectional perspective view schematically illustrating a state of the shift unit assembled inside a shift unit storage chamber of the lower unit housing.

Next, a description will be made for a configuration of the shift unit 4 with reference to FIGS. 3 to 6. FIG. 3 is an exploded perspective view schematically illustrating an exemplary configuration of the shift unit 4. FIG. 4 is a perspective view schematically illustrating an exemplary configuration of the shift unit 4. FIG. 5 is a cross-sectional view illustrating an exemplary configuration of the shift unit 4. FIG. 6 is a cross-sectional perspective view schematically illustrating a state of the shift unit 4 assembled in the inside of the shift unit storage chamber 106 of the lower unit housing 103. It is noted that FIG. 3 collectively shows both disassembled and assembled states of the intermediate gear module 401 to and from the lower unit housing 103.

The shift unit 4 has an upper gear 41 as a first gear, an intermediate gear module 401 having an intermediate gear 42, a lower gear 44 as a second gear, a dog clutch 45 (clutch body), an actuator 5, a shift fork member 61, and a shift fork guide 62. In addition, the shift unit 4 is housed in the shift unit storage chamber 106 formed in the inside of the lower unit housing 103. The shift unit storage chamber 106 is a space formed in the vicinity of the upper side inside the lower unit housing 103 and opened upwardly (in the side coupled to the drive shaft housing 102). In addition, a lid member 71 for blocking an opening in the upper side of the shift unit storage chamber 106 is installed in the upper portion of the lower unit housing 103. As a result, it is possible to prevent a foreign object such as water from intruding to the shift unit storage chamber 106 from the outside. Furthermore, the actuator 5, the shift fork guide 62, and the upper gear 41 of the shift unit 4 are supported by the lid member 71.

The lid member 71 is formed in a flat panel shape. In addition, in order to block an opening of the shift unit storage chamber 106 of the lower unit housing 103, the lid member 71 is shaped to match the shape of the upper edge of the opening as seen in a plan view.

In the front side of the lid member 71, a vertically penetrating opening 711 is formed. The actuator 5 is fixed to the lid member 71 while it is fitted to the opening 711 from the upside and protrudes downward. The lid member 71 is provided with a trench (not shown) for inserting a gasket 714 to surround the opening 711. A bearing support portion 712 is provided in the center of the lid member 71 in the front-rear direction and in rear of the opening 711. The bearing support portion 712 is a part for housing and supporting a bearing 413 (refer to FIG. 2) that rotatably supports the upper drive shaft 171 and a bearing 412 (refer to FIG. 2) that rotatably supports the upper gear 41. The bearing support portion 712 has a cylindrical configuration having an internal space in order to internally house and support the bearings 412 and 413. In addition, the bearing support portion 712 protrudes (i.e., swells) upwardly relatively to other parts of the lid member 71 and is opened in the bottom. On the lower surface of the lid member 71, a guide support portion 713 for holding the shift fork guide 62 described below is provided between the opening 711 and the bearing support portion 712 as seen in a side view. The guide support portion 713 has a cylindrical configuration protruding downward from the lower surface of the lid member 71 so that the upper end of the shift fork guide 62 can be inserted thereto. In addition, the guide support portion 713 is provided with a vertically penetrating through-hole so that a bolt 64 can be inserted from the upper surface side. Furthermore, on the lower surface of the lid member 71, a trench for fitting a gasket 714 is formed along the outer circumferential edge as seen in a plan view.

Meanwhile, in the upper end of the shift unit storage chamber 106 of the lower unit housing 103, an engagement surface 107 is provided to surround the shift unit storage chamber 106 as seen in an upper view. The engagement surface 107 is a surface which sees the upside and is perpendicular to the axial direction of the drive shaft 17. The engagement surface 107 is a surface where the lid member 71 is attached and also serves as a dividing surface between the lower unit housing 103 and the lid member 71.

The lid member 71 is installed from the upper side of the lower unit housing 103. Specifically, while the gasket 714 is fitted to the trench provided in the circumferential edge of the lower surface of the lid member 71, the circumferential edge of the lower surface of the lid member 71 is overlapped with the engagement surface of the lower unit housing 103. In addition, the lid member 71 is detachably fixed to the lower unit housing 103 using a bolt and the like. In this configuration, the shift unit storage chamber 106 provided in the lower unit housing 103 is blocked by the lid member 71. Sealing (water-tightness) is obtained by the gasket 714 between the lid member 71 and the engagement surface of the lower unit housing 103. Therefore, the shift unit storage chamber 106 is prevented from intrusion of water and the like from the outside.

The upper gear 41 is supported by the bearing 412 rotatably with respect to the bearing support portion 712 of the lid member 71. As the bearing 412, a radial ball bearing, a radial roller bearing, and the like may be employed. In addition, the upper gear 41 is engaged with the lower end of the upper drive shaft 171 so as to rotate in synchronization with the upper drive shaft 171. For example, the upper gear 41 and the lower end of the upper drive shaft 171 are coupled in a spline-like manner. The upper gear 41 meshes with the intermediate gear 42 at all times. In addition, the upper gear 41 transmits, to the intermediate gear 42, the rotational power transmitted from the engine 13 via the upper drive shaft 171 at all times. It is noted that a bevel gear may be employed as the upper gear 41. The lower surface of the upper gear 41 is provided with a catch 411 (dog) that can be engaged with the upper ratchet 451 of the dog clutch 45.

The intermediate gear module 401 has an intermediate gear 42, a middle shaft 43 rotating in synchronization with the intermediate gear 42, a bearing that rotatably supports the middle shaft 43, and a bearing housing 47. The intermediate gear 42 and the middle shaft 43 are arranged such that their axial lines are in parallel with the front-rear direction. A bevel gear may be employed as the intermediate gear 42. The intermediate gear 42 is provided between the upper and lower gears 41 and 44 and meshes with them at all times. In addition, the intermediate gear 42 transmits, to the lower gear 44, the rotational power transmitted from the upper gear 41 at all times. It is noted that the intermediate gear module 401 is a member separate from the lower unit housing 103. In addition, the intermediate gear module 401 is detachably installed to the lower unit housing 103 using a bolt 476 and a nut 473. Furthermore, the intermediate gear module 401 is arranged in rear of the drive shaft 17. It is noted that the configuration of the intermediate gear module 401 will be described in more detail below.

The lower gear 44 is arranged coaxially with the upper gear 41 under the upper gear 41 with a predetermined distance. A bevel gear is employed as the lower gear 44. The lower gear 44 is rotatably supported by interposing the bearing 442 inside the shift unit storage chamber 106 of the lower unit housing 103. As the bearing 442, for example, a radial ball bearing or a radial roller bearing may be employed. The lower gear 44 meshes with the intermediate gear 42 at all times so that the rotational power is transmitted from the upper gear 41 via the intermediate gear 42. In this configuration, the lower gear 44 rotates reversely to the upper gear 41. It is noted that the upper surface of the lower gear 44 is provided with a catch 441 (dog) that can be engaged with the lower ratchet 452 of the dog clutch 45.

The upper end of the lower drive shaft 172 protrudes to a gap between the upper and lower gears 41 and 44 through the shaft hole of the lower gear 44. It is noted that the lower gear 44 and the lower drive shaft 172 are not fixed and can rotate independently from each other.

The dog clutch 45 is provided in the outer circumference of the upper end of the lower drive shaft 172 (i.e., a part of the lower drive shaft 172 between the upper and lower gears 41 and 44). Although the dog clutch 45 rotates in synchronization with the lower drive shaft 172, it can reciprocate along its axial direction (vertical direction) with respect to the lower drive shaft 172. For example, a spline hole is employed in the shaft hole of the dog clutch 45, and a spline shaft is employed in the upper end of the lower drive shaft 172. In addition, the dog clutch 45 and the upper end of the lower drive shaft 172 are coupled in a spline-like manner. An upper ratchet 451 (dog) is provided on the upper surface of the dog clutch 45, and a lower ratchet 452 (dog) is provided on the lower surface.

As the dog clutch 45 moves upward, the upper ratchet 451 of the dog clutch 45 and the catch 411 on the lower surface of the upper gear 41 are engaged with each other, so that the dog clutch 45 rotates in synchronization with the upper gear 41. For this reason, the rotational power of the upper drive shaft 171 is transmitted to the lower drive shaft 172 via the upper gear 41 and the dog clutch 45. Meanwhile, as the dog clutch 45 moves downward, the lower ratchet 452 of the dog clutch 45 and the catch 441 on the upper surface of the lower gear 44 are engaged with each other, so that the dog clutch 45 rotates in synchronization with the lower gear 44. For this reason, the rotational power of the upper drive shaft 171 is transmitted to the lower drive shaft 172 via the upper gear 41, the intermediate gear 42, the lower gear 44, and the dog clutch 45. If the dog clutch 45 is located in the middle of the vertical movement range, the upper ratchet 451 of the dog clutch 45 is not engage with the catch 411 of the upper gear 41, and the lower ratchet 452 is not engaged with the catch 441 on the upper surface of the lower gear 44. For this reason, the rotational power of the upper drive shaft 171 is not transmitted to the lower drive shaft 172.

Here, an exemplary configuration of the intermediate gear module 401 will be described. The intermediate gear module 401 has an intermediate gear 42, a middle shaft 43, a pair of bearings 471, a bearing housing 47, and nuts 474 and 475.

The intermediate gear 42 and the middle shaft 43 are arranged such that their axial lines are in parallel with the front-rear direction. A bevel gear is employed in the intermediate gear 42 as described above. In addition, the intermediate gear 42 is provided in the front end of the middle shaft 43 so as to rotate in synchronization with the middle shaft 43. The middle shaft 43 is supported by a pair of bearings 471 rotatably with respect to the bearing housing 47. The front and rear ends of the middle shaft 43 are provided with male threads in order to allow nuts 474 and 475, respectively, to be fastened. Tapered roller bearings are employed in a pair of bearings 471. In addition, a pair of bearings 471 (tapered roller bearings) are arranged side by side along the front-rear direction coaxially and oppositely.

The bearing housing 47 houses a pair of bearings 471. For example, the bearing housing 47 does not have a half-divided structure but has an integrated structure. For example, the bearing housing 47 is formed of metal such as steel in an integrated manner. In addition, a locking portion 477 for locking the bearing 471 is provided in an approximate axial center of the inner circumferential surface of the bearing housing 47. For example, the locking portion 477 has a rib-shaped configuration that protrudes inward in a radial direction and extends in a circumferential direction. It is noted that the configuration of the locking portion 477 is not limited thereto. Any structure may be employed if it can be locked to the end surface of the bearing 471 housed in the bearing housing 47.

One of the pair of bearings 471 is fitted from the front side to the bearing housing 47, and the other bearing 471 is fitted from the rear side. Each end surface of the pair of bearings 471 fitted to the bearing housing 47 is locked to the locking portion 477 of the bearing housing 47. In addition, the middle shaft 43 is inserted into the pair of bearings 471. In this state, the nut 474 is fastened to the rear end of the middle shaft 43. Furthermore, the intermediate gear 42 is fitted to the front end of the middle shaft 43, and the nut 475 is fastened from the front side. In this manner, the nuts 474 and 475 fastened to both ends of the middle shaft 43 serve as a first preload member that applies a preload to the pair of bearings 471 in an axial direction. It is noted that the bearing 471 provided in the front side receives a preload using the nut 475 through the intermediate gear 42. In this manner, according to this embodiment, a pair of bearings 471 receives preload using nuts 474 and 475 fastened to the middle shaft 43. In addition, since a pair of nuts 474 and 475 is fastened to the middle shaft 43, the intermediate gear 42, the middle shaft 43, the bearing housing 47, and a pair of bearings 471 are modularized so as to form the intermediate gear module 401.

In this manner, the bearing housing 47 is a member separate from the lower unit housing 103. In this configuration, the bearing housing 47 and the lower unit housing 103 can be formed using different types of materials. For example, the lower unit housing 103 may be formed of aluminum or aluminum alloy in terms of a light weight, and the bearing housing 47 may be formed of steel in terms of strengths. For this reason, it is possible to improve stiffness of the bearing housing 47 and apply a high preload to the bearing 471.

The bearing housing 47 is not a combination of plural members such as a half-dividing structure but a single member formed in an integrated manner. In this configuration, it is possible to improve dimensional accuracy in the inner circumference of the bearing housing 47 (i.e., a part where the bearing 471 is housed). In addition, since dimensional accuracy of the bearing housing 47 is improved, it is possible to improve assembly accuracy of the middle shaft 43 and reduce a rotational deflection of the middle shaft 43. Therefore, it is possible to improve teeth contact accuracy between the intermediate gear 42 and the upper and lower gears 41 and 44 and increase service lifetimes of the gears.

According to this embodiment, the intermediate gear 42, the middle shaft 43, the bearing housing 47, and a pair of bearings 471 are modularized. In this configuration, the intermediate gear module 401 can be assembled as a single body separate from the lower unit 903. For this reason, during a process of assembling the intermediate gear module 401, it is possible to easily apply a preload to the bearings 471. Furthermore, since the intermediate gear module 401 is formed from small-sized and light-weight components, the assembling work becomes easy. Moreover, since the component for applying a preload is also small-sized, it is possible to reduce a dimensional deviation.

The intermediate gear module 401 is housed in the shift unit storage chamber 106 of the lower unit housing 103 and is detachably installed to the lower unit housing 103. For example, the bearing housing 47 is provided with a plurality of vertically penetrating through-holes 472 where the bolt 476 can be inserted. Meanwhile, the bolt 476 is fixed to the lower unit housing 103 so as to protrude upward. In addition, the bolt 476 is inserted into the through-hole 472, and the nut 473 is fastened to a part protruding from the through-hole 472. As a result, the intermediate gear module 401 is detachably installed to the lower unit housing 103.

Next, a description will be made for the actuator 5. The actuator 5 shifts the dog clutch 45 along the axial direction of the drive shaft 17 by using the shift fork member 61. As a result, the shift position is switched. According to this embodiment, an electric linear motor type actuator is employed as the actuator 5. The electric motor type actuator 5 is advantageous in comparison with a hydraulic type as described below. First, the hydraulic type necessarily has a configuration for generating a hydraulic pressure, and power for generating the hydraulic pressure is necessarily distributed from the engine 13. In comparison, since the electric type does not necessitate such a configuration, it is possible to improve fuel efficiency. In addition, while the hydraulic type necessarily has a hydraulic mechanism such as a hydraulic pipe or a solenoid valve, the electric type does not necessitate such mechanism. For this reason, it is possible to simplify the structure and reduce manufacturing or component costs. Furthermore, when the lower unit housing 103 is disassembled from the drive shaft housing 102, a mechanism or work for preventing oil leakage is necessary in the hydraulic type. However, the electric type does not necessitate such a mechanism or work.

As illustrated in FIGS. 3 to 5, the actuator 5 is provided to adjoin the front side of the dog clutch 45. In particular, the actuator 5 and the dog clutch 45 are arranged in nearly the same height. The actuator 5 has a motor 51, an intermediate gear 52, and a ball screw mechanism 53. The motor 51, the intermediate gear 52, and the ball screw mechanism 53 are housed in the housing 501. The motor 51 is a driving power source of the actuator 5 and outputs rotational power. As a rotational power output shaft of the motor 51, a drive gear 510 is provided. The intermediate gear 52 and the drive gear 510 of the motor 51 mesh with a ball screw nut 531, so that the rotational power of the motor 51 is transmitted to the ball screw nut 531. The ball screw mechanism 53 has the ball screw nut 531 and a screw shaft 532. The ball screw nut 531 is also a gear having tooth in its outer circumference (external gear). The screw shaft 532 of the ball screw mechanism 53 is a power output member of the ball screw mechanism and is shifted (rectilinear motion) in its axial direction along with rotation of the ball screw nut 531.

In this manner, the actuator 5 is a linear motion type actuator that converts the rotational power of the motor 51 into a rectilinear motion of the screw shaft 532 and outputs it. As illustrated in FIGS. 3 to 5, the screw shaft 532 as a power output member of the ball screw mechanism 53 has an axial line arranged in parallel with the axial line of the drive shaft 17. That is, the screw shaft 532 performs a linear reciprocating motion in parallel with the drive shaft 17. It is noted that the outer circumference of the screw shaft 532 of the ball screw mechanism 53 has a (male) thread for connection of the shift fork member 61.

The housing 501 of the actuator 5 has an upper/lower half structure including upper and lower half bodies 502 and 503. The lower half body 503 internally has a motor storage chamber 504 for storing the motor 51 and a ball screw mechanism storage chamber 505 for storing the ball screw mechanism 53. The motor storage chamber 504 is an upwardly-opened bottomed area. The ball screw mechanism storage chamber 505 is upwardly opened and has a bottom having a through-hole 506 where the screw shaft 532 is inserted. The ball screw nut 531 is stored in the ball screw mechanism storage chamber 505 and is supported rotatably by interposing a bearing. The lower portion of the screw shaft 532 protrudes outward (downward) from the through-hole 506 formed in the bottom of the ball screw mechanism storage chamber 505. It is noted that the through-hole 506 is provided with a packing and the like in order to prevent oil and the like from intruding from the shift unit storage chamber 106. The upper edge of the lower half body 503 of the housing 501 is provided with an flange-shaped engagement portion 507 extending outward as seen in a plan view.

Meanwhile, the upper half body 502 of the housing 501 has a downwardly opened box-like configuration. Similar to the lower half body 503, the lower edge of the upper half body 502 is provided with a flange-shaped engagement portion extending outward as seen in a plan view. In addition, the upper portion of the upper half body 502 is provided with a through-hole that allows the inside and the outside of the housing 501 to communicate with each other. A cable assembly is routed through the through-hole formed in the upper half body 502. It is noted that this through-hole is provided with a water stop grommet and the like in order to prevent water and the like from intruding from the outside.

While the engagement portion of the upper half body 502 and the engagement portion 507 of the lower half body 503 are overlapped with each other, a bolt is fixed to the lid member 71. For this reason, the lower half body 503 of the housing 501 protrudes downward from the opening 711 of the lid member 71. Meanwhile, the upper half body 502 of the housing 501 is provided over the lid member 71.

It is noted that, as illustrated in FIG. 1, the motor 51 of the actuator 5 is provided under the lower mount bracket 146 where the lower end of the pilot shaft 143 is fixed. In addition, the motor 51 is provided in the front side relatively to the pilot shaft 143 as seen in a side view. In this manner, the front end of the lower unit housing 103 is positioned in the front side relatively to the pilot shaft 143 as seen in a side view. In this configuration, it is possible to improve steering performance of the outboard motor 1. That is, when the outboard motor 1 is steered in the left or right side, a difference of the water flow speed is generated between the left and right sides of the lower unit housing 103, and this difference of speed generates a yawing force (lifting force) in the lower unit housing 103. In addition, if a steering center (that is, the center of the pilot shaft 143) is located near the center of this lift force, steering performance is improved. As in this embodiment, if the front end of the lower unit housing 103 is arranged to overhang to the front side relatively to the pilot shaft 143, and the motor 51 is arranged therein, it is possible to shift the center of the lifting force toward the front side to be near the pilot shaft 143. Therefore, it is possible to improve steering performance.

A cable assembly for transmitting signals or electric power for driving or controlling the actuator 5 is extracted to the upper side from the upper half body 502 of the housing 501, passes through the inside of the pilot shaft 143 which is a cavity shaft, and reaches the vicinity of the steering bracket (not shown) from the upper end of the pilot shaft 143. In addition, the end of the cable assembly is connected to a control box (not shown) provided in a ship or a steering handle. A ship operator can switch the shift position by manipulating a control box or the like to control the actuator 5.

The shift fork guide 62 is a guide member that enables the shift fork member 61 to reciprocate in parallel with the axial line of the drive shaft 17. As illustrated in FIGS. 3 to 5, the shift fork guide 62 is a bar-shaped member. The shift fork guide 62 is provided between the actuator 5 and the drive shaft 17 such that its axial line is in parallel with the axial line of the drive shaft 17 (the axial line is in parallel with the vertical direction). The shift fork guide 62 is installed in the lid member 71.

An assembly structure of the shift fork guide 62 will be described. The lid member 71 is provided with a guide support portion 713 that supports the shift fork guide 62. The guide support portion 713 has a columnar shape protruding from the lower surface of the lid member 71 to the lower side. In addition, its lower end surface is provided with a hollow where the upper end of the shift fork guide 62 can be inserted. Meanwhile, the lower unit housing 103 is also provided with a guide support portion that supports the shift fork guide 62. The hollow provided in the inner circumferential surface of the shift unit storage chamber 106 of the lower unit housing 103 may be employed in this guide support portion. In addition, the upper end of the shift fork guide 62 is fitted to the hollow of the guide support portion 713 of the lid member 71, and the lower end is fitted to the hollow corresponding to the guide support portion provided in the inner circumferential surface of the shift unit storage chamber 106. As a result, the upper and lower ends of the shift fork guide 62 are supported by the lid member 71 and the lower unit housing 103, respectively.

It is noted that the shift fork guide 62 may have an assembly structure as described below. A vertically penetrating through-hole is formed in the inside of the guide support portion 713 of the lid member 71. The inner diameter of the through-hole is set to be different between the upper and lower sides such that the lower side is larger than the upper side. For this reason, a downward step surface is provided inside the guide support portion 713. The upper end of the shift fork guide 62 inserted into the guide support portion 713 abuts on the internal step surface of the guide support portion 713 so as to be positioned in the axial direction. The upper end of the shift fork guide 62 is provided with a female thread. In addition, a bolt 64 is inserted from the upper side of the lid member 71 to this through-hole and is screwed to the female thread of the shift fork guide 62. As a result, the shift fork guide 62 is held in the lid member 71 in the positioned state.

The shift fork member 61 is provided so as to slidingly reciprocate along the shift fork guide 62. The shift fork member 61 is driven by the screw shaft 532 of the ball screw mechanism 53 to make a rectilinear motion in parallel with the axial direction of the shift fork guide 62 (i.e., the axial direction of the drive shaft 17) to shift the dog clutch 45 in the axial direction of the drive shaft 17. The shift fork member 61 has a slide portion 611, a fork portion 612, and a follower portion 613.

The slide portion 611 has a cylindrical configuration having a through-hole. In addition, the shift fork guide 62 is inserted into the through-hole of the slide portion. For this reason, the shift fork member 61 including the slide portion 611 can reciprocate in a sliding manner in parallel with the axial direction of the shift fork guide 62 (i.e., the axial direction of the drive shaft 17).

The fork portion 612 extending from the slide portion 611 to the rear side is engaged with the dog clutch. The fork portion 612 has, for example, an approximately U-shaped arm as seen in a plan view, and this arm is engaged with the dog clutch 45. For example, a trench extending in a circumferential direction is formed in the outer circumferential surface of the dog clutch 45, and the fork portion 612 (approximately U-shaped arm) is fitted to this trench. For this reason, while the dog clutch 45 is rotatable with respect to the shift fork member 61, it is shifted in parallel with the axial direction of the drive shaft 17 as the shift fork member 61 is shifted in the axial direction.

The follower portion 613 extending from the slide portion 611 to the front side is coupled to the screw shaft 532 of the ball screw mechanism 53. The front end of the follower portion 613 is provided with a female thread. In addition, the front end of the follower portion 613 is connected to the male thread provided in the screw shaft 532 of the ball screw mechanism 53. For this reason, the shift fork member 61 including the follower portion 613 makes a rectilinear motion in parallel with the axial direction of the shift fork guide 62 as the screw shaft 532 of the ball screw mechanism 53 makes a rectilinear motion. As described above, the axial line of the screw shaft 532 of the ball screw mechanism 53, the axial line of the shift fork guide 62, and the axial line of the drive shaft 17 are vertically in parallel with each other.

It is noted that any configuration may be employed in the fork portion 612 of the shift fork member 61 without a particular limitation if it can be engaged with the dog clutch 45 so as to shift the dog clutch 45 in the axial direction of the drive shaft 17. Similarly, any configuration may be employed in the follower portion 613 of the shift fork member 61 without a particular limitation if it can be coupled to the screw shaft 532 of the ball screw mechanism 53.

Here, a description will be made for an exemplary method of assembling the lower drive shaft 172 and the shift unit 4 to the lower unit housing 103. In the outboard motor 1 according to this embodiment, the front gear 21 and the pinion gear 18 are assembled, and the lower drive shaft 172 is then assembled. Then, the shift unit 4 is assembled. Both the lower drive shaft 172 and the shift unit 4 can be assembled to the lower unit housing 103 from the top. As described above, the upper side of the lower unit housing 103 is opened, and the shift unit storage chamber 106 is provided in the vicinity of the upper side of the lower unit housing 103. Therefore, the assembling work becomes easy.

First, the bearing 46 that rotatably supports the lower drive shaft 172 is mounted to the outer circumference of the lower drive shaft 172. This bearing 46 is a double row type tapered roller bearing having a single outer race 462 and a pair of tapered roller rows 461. The lower drive shaft 172 is provided with a step surface engaged with the end surface of the inner race of one of the bearings 46 (which is the inner race positioned in the lower side in a mounted state). This step surface faces the upper side. In addition, the bearing 46 is mounted from the upper side of the lower drive shaft 172. As the bearing 46 is mounted to the lower drive shaft 172, the end surface of the inner race in the lower side of the bearing 46 is locked to the step surface provided in the lower drive shaft 172. In addition, in this state, the ring nut 464 is fastened from the upper side of the lower drive shaft 172. Specifically, the lower drive shaft 172 is provided with a male thread, and this ring nut 464 is fastened to the male thread of the lower drive shaft 172. As a result, the bearing 46 is interposed between the step surface provided in the lower drive shaft 172 and the ring nut 464.

A pressurization applied to the bearing 46 is adjusted by controlling the fastening force of the ring nut 464. It is noted that various shims may be interposed between the bearing 46 and the ring nut 464. In this manner, the ring nut 464 serves as a second preload member that applies a preload to the bearing 46. In this configuration, it is possible to easily control the pressurization applied to the bearing 46. That is, according to this embodiment, it is possible to control the pressurization applied to the bearing 46 just by fastening the ring nut 464. In addition, since the ring nut 464 is a small-sized component, a dimensional deviation is insignificant, and an assembling work is also easy.

While the bearing 46 is mounted, the lower drive shaft 172 is housed in the bearing storage chamber 108 provided in the lower unit housing 103 from the upper side. This bearing storage chamber 108 is an upwardly opened space. In addition, a through-hole where the lower end of the lower drive shaft 172 is inserted is provided in the bottom of the bearing storage chamber 108.

While a portion of the lower drive shaft 172 where the bearing 46 is mounted is housed in the bearing storage chamber 108, the holding member 463 is fastened from the upper side. Specifically, the holding member 463 is a ring-shaped member having a male thread in its outer circumferential surface, and the inner circumferential surface of the bearing storage chamber 108 is provided with a female thread. In addition, the holding member 463 is fastened to the female thread of the bearing storage chamber 108. As a result, the bearing 46 is held inside the bearing storage chamber 108. This holding member 463 has a function of controlling a tooth contact between the pinion gear 18, the front gear 21, and the rear gear 22. That is, as rotational power is transmitted from the pinion gear 18 to the front and rear gears 21 and 22, a reactive force is applied to the lower drive shaft 172 to be lifted. For this reason, the upper end of the outer race 462 of the bearing 46 is pressed by the holding member 463. In this regard, by controlling the position of the holding member 463, it is possible to control a tooth contact while the rotational power is transmitted to the front and rear gears 21 and 22 from the pinion gear 18. In addition, the control of this tooth contact may be performed just by controlling the position of the holding member 463, and this work can be performed from the top. Therefore, it is possible to obtain excellent workability.

According to this embodiment, the bearing 46 that rotatably supports the lower drive shaft 172 is a double row type tapered roller bearing having a single outer race 462. In this configuration, compared to a configuration having a plurality of bearings, it is possible to shorten a length of the portion where the bearing 46 is mounted. For this reason, it is possible to shorten a distance to the pinion gear 18 from the ring nut 464 which is a preload member for applying a preload to the bearing 46. Therefore, it is possible to improve stiffness of the lower unit housing 103 while reducing its vertical dimension. In addition, since it is possible to shorten the distance from the pinion gear 18 to the ring nut 464, it is possible to reduce deformation of the lower drive shaft 172 in the axial direction generated by a reactive force applied to the pinion gear 18 during driving. For this reason, it is possible to reduce a deviation of the tooth contact between the pinion gear 18, the front gear 21, and the rear gear 22 and increase service lifetimes of the gears.

The bearing 442 and the lower gear 44 are assembled to the lower unit housing 103 from the upper side of the lower drive shaft 172. The lower gear 44 is supported by the bearing 442 rotatably with respect to the lower unit housing 103. That is, the lower gear 44 is mounted to the lower unit housing 103 by using the bearing 442. It is noted that the lower gear 44 and the lower drive shaft 172 are not coupled to each other, and they can be rotated independently. In this configuration, the control of the tooth contact between the lower gear 44 and the intermediate gear 42 may be performed just by exchanging the shim arranged in the lower side of the lower gear 44 or the bearing 442. Therefore, the control of the tooth contact can be performed easily within a short time period.

In this configuration, during the forward driving, a reactive force (thrust load) of the lower drive shaft 172 received from the front and rear gears 21 and 22 through the pinion gear 18 is applied to the bearing 46. Meanwhile, during the backward driving, a reactive force (thrust load) of the lower gear 44 received from the intermediate gear 42 is applied to the bearing 442. According to this embodiment, it is possible to reduce outer diameters of the bearings 46 and 442 to be approximately the same. For this reason, it is possible to reduce a dimension of the portion of the lower unit housing 103 where the bearings 46 and 442 are provided. Therefore, it is possible to reduce a flow resistance of the lower unit housing 103.

Then, the intermediate gear module 401 is assembled to the rear side of the drive shaft 17. The intermediate gear module 401 is detachably installed in the shift unit storage chamber 106 of the lower unit housing 103 by using a bolt 476 and a nut 473. As the intermediate gear module 401 is housed in and fixed to the shift unit storage chamber 106, the lower gear 44 and the intermediate gear 42 mesh with each other.

The actuator 5 and the shift fork guide 62 are assembled to the lid member 71. In addition, the shift fork member 61 is assembled to the actuator 5 and the shift fork guide 62. Specifically, the housing 501 assembled with the motor 51, the intermediate gear 52, and the ball screw mechanism 53 is fitted to the opening 711 of the lid member 71 from the upper side. As a result, the housing 501 is engaged such that the engagement portion 507 of the lower half body 503 is overlapped with the upper surface of the circumferential edge of the opening 711 of the lid member 71. In addition, the lower half body 503 of the housing 501 of the actuator 5 protrudes to the lower side of the lid member 71 (i.e., the inside of the shift unit storage chamber 106) through the opening 711 of the lid member 71. Furthermore, the screw shaft 532 protrudes downward from the bottom surface of the lower half body 503 of the housing 501 of the actuator 5.

It is noted that a gasket 508 is fitted to the trench surrounding the opening 711 of the lid member 71. As the housing 501 of the actuator 5 is installed in the lid member 71, the opening 711 of the lid member 71 is blocked by the lower half body 503 of the housing 501. That is, the housing 501 of the actuator 5 serves as a lid for blocking the opening 711 of the lid member 71. In addition, the gasket 508 is interposed between the lower surface of the engagement portion 507 of the housing 501 and the upper surface of the lid member 71. Furthermore, the gasket 508 seals the shift unit storage chamber 106 to prevent water or the like from intruding to the inside.

The shift fork guide 62 is installed to the guide support portion 713 provided on the lower surface of the lid member 71. As described above, the upper end of the shift fork guide 62 is fitted to the hollow of the guide support portion 713 provided in the lid member 71. Alternatively, the shift fork guide 62 is fixed to the lower side of the lid member 71 by using the bolt 64 inserted from the upper side of the lid member 71. In this case, using this bolt 64, the lower half body 503 of the housing 501 and the shift fork guide 62 are fixed to the lid member 71 at the same time.

The slide portion 611 of the shift fork member 61 is engaged with the shift fork guide 62. In addition, the follower portion 613 of the shift fork member 61 is coupled to the screw shaft 532 of the ball screw mechanism 53 protruding downward from the housing 501.

The bearing 413 that rotatably supports the upper drive shaft 171 and the bearing 412 that rotatably supports the upper gear 41 are housed in the bearing support portion 712 of the lid member 71 from the lower side, and the upper gear 41 is further fitted from the lower side. Alternatively, after the bearing 412 is installed to the upper gear 41, the bearing 412 is housed in the bearing support portion 712 from the lower side. As a result, the upper gear 41 is supported by the bearing 412 rotatably with respect to the lid member 71. Since the bearing support portion 712 is opened downwardly, such a process can be performed from the lower side of the lid member 71.

The lid member 71 assembled with the actuator 5, the shift fork guide 62, and the upper gear 41 is installed to the upper side of the lower unit housing 103. In this case, the dog clutch 45 is engaged with the fork portion 612 of the shift fork member 61. In addition, the gasket 714 is fitted to the trench provided in the circumferential edge of the lower surface of the lid member 71. The upper edge of the shift unit storage chamber 106 of the lower unit housing 103 is provided with the engagement surface 107 to surround the opening of the shift unit storage chamber 106 as seen in a top view. The engagement surface 107 is an upwardly facing surface. In addition, a plurality of screw holes is provided in the outer side of the engagement surface 107. Into the screw holes, bolts can be fastened from the upper side while their axial lines are in parallel with the vertical direction. In addition, the lid member 71 is detachably installed to the lower unit housing 103 by using bolts. As the lid member 71 is installed in the lower unit housing 103, the outer circumferential edge of the lower surface of the lid member 71 is overlapped with the engagement surface 107 of the lower unit housing 103. In addition, the gasket 714 is interposed between the lower surface of the lid member 71 and the engagement surface 107 of the lower unit housing 103. Therefore, it is possible to prevent water or the like from intruding to the shift unit chamber 106 from the outside.

In this manner, according to this embodiment, the shift unit 4 is arranged in the vicinity of the coupling surface between the lower unit housing 103 and the drive shaft housing 102 as seen in a side view and is detachably installed to the lower unit housing 103. In this configuration, as the lower unit housing 103 is uninstalled from the drive shaft housing 102, the shift unit 4 is positioned on top of the lower unit housing 103. For this reason, since accessibility from the upper side (i.e., the opening side) is improved, maintainability is improved.

The actuator 5 is installed in the lid member 71, and the upper drive shaft 171 and the upper gear 41 are rotatably supported by the bearing support portion 712 provided in the lid member 71. For this reason, it is possible to easily make the screw shaft 532 of the actuator 5 and the upper drive shaft 171 to be parallel to each other. Therefore, it is possible to improve assembly accuracy.

Even when the lower unit housing 103 as a casing of the lower unit 903 is dissembled from the drive shaft housing 102 as a casing of the middle unit 902, the opening of the shift unit storage chamber 106 is maintained in a state covered by the lid member 71. For this reason, even after the lower unit housing 103 is disassembled from the drive shaft housing 102, it is possible to prevent a foreign object from intruding into the shift unit storage chamber 106 or oil from leaking from the shift unit storage chamber 106. Therefore, it is possible to hold the lower unit 903 in the state of lying sideways.

It is noted that, if the intermediate gear module 401 is modularized separately from the lower unit housing 103 and is detachably installed to the lower unit housing 103, it is possible to make the engagement surface 107 in a simple plane shape. That is, the intermediate gear 42 and the middle shaft 43 have axial lines in parallel with the front-rear direction. For this reason, if the bearing 471 is integrated with the lower unit housing 103, it is necessary to form a notch or the like for preventing interference with a tool for forming the through-hole in front or rear of the lower unit housing 103 in order to form the through-hole penetrating in the front-rear direction. For this reason, the engagement surface 107 is not a simple plane surface, but becomes a three-dimensional shape depending on a notch. If the engagement surface 107 has a three-dimensional shape, it is difficult to maintain water-tightness between the lower unit housing 103 and the lid member 71. In comparison, according to this embodiment, since the engagement surface 107 can be made in a simple plane shape, it is possible to easily obtain water-tightness between the lower unit housing 103 and the lid member 71.

According to this embodiment, the housing 501 of the actuator 5 serves as a lid of the opening 711 provided in the lid member 71. Therefore, if the entire housing 501 of the actuator 5 is housed in the shift unit storage chamber 106, a dedicated lid member separate from the housing 501 is necessary. However, in the configuration according to this embodiment, no dedicated lid member is necessary. In addition, the cable assembly connected to the motor 51 and the like housed in the housing 501 is extracted to the upper side from the upper half body 502. In this configuration, the cable assembly is not routed inside the shift unit storage chamber 106. Therefore, it is not necessary to provide heat resistance or oil resistance in the cables.

According to this embodiment, the actuator 5 is provided in the vicinity of the front side of the dog clutch 45. In addition, the actuator 5 (in particular, the screw shaft 532 protruding from the housing 501) and the dog clutch 45 are provided in nearly the same height. In this configuration, since the distance between the actuator 5 and the dog clutch 45 is reduced, it is possible to reduce a size and a weight of the shift fork member 61 interposed between the actuator 5 and the dog clutch 45. In addition, the inertia of the shift fork member 61 is reduced as the weight is reduced. Therefore, it is possible to improve the operation speed and the operation accuracy. Furthermore, if the actuator 5 and the dog clutch 45 are in nearly the same height, it is possible to reduce the number of components interposed therebetween. For this reason, it is possible to reduce rattling of the components interposed therebetween. Therefore, it is possible to obtain an accurate shift operation. In this configuration, it is possible to improve stiffness of a mechanism for shifting the dog clutch 45 including a mechanism interposed therebetween. For this reason, a deflection caused by a driving force or a reactive force of the actuator 5 is reduced, so that an accurate shift operation can be obtained. Moreover, in this configuration, a positional deviation therebetween is reduced. For this reason, it is possible to easily measure or estimate an operation amount of the actuator 5 necessary to switch the shift position.

If the actuator 5 is arranged over the dog clutch (for example, inside the engine cover 101) as in the prior art, a link mechanism such as a long shift rod is necessary in order to transmit the driving force from the actuator 5 to the dog clutch 45. In addition, a mechanism for supporting the shift rod is also necessary. For this reason, rattling of the link mechanism or swagging of the shift rod may make it difficult to drive the dog clutch 45 accurately. In comparison, according to this embodiment, the actuator 5 is arranged in the vicinity of the front side of the dog clutch 45, and the dot clutch 45 is shifted by using the shift fork member 61. In this configuration, compared to the configuration of the prior art, it is possible to miniaturize or simplify the mechanism for transmitting a driving force from the actuator 5 to the dog clutch 45. In addition, since rattling or deflection of the mechanism is reduced, it is possible to improve accuracy of the operation amount of the dog clutch 45. Compared to the configuration of the prior art, it is possible to reduce the number of portions that generate losses in transmission of the driving force due to friction and the like. Therefore, it is not necessary to increase a driving force of the actuator 5, and it is possible to miniaturize the actuator 5.

Similar to the gears used to switch the shift position (such as the upper gear 41, the intermediate gear 42, and the lower gear 44), the dog clutch 45 and the actuator 5 are provided in the lower unit housing 103. In this configuration, the dog clutch 45, the actuator 5, and the like can be installed based on the same installation standard as that of the gears described above. For this reason, it is possible to improve relative positional accuracy therebetween and perform smooth shift operation.

Similar to the upper gear 41, the intermediate gear 42, the lower gear 44, and the dog clutch 45, the actuator 5 and the shift fork member 61 are installed in the lower unit housing 103. For this reason, it is possible to perform an operational check of the shift unit 4 while the lower unit 903 has a separate unassembled state before the lower unit housing 103 is assembled to the drive shaft housing 102. That is, the entire shift unit 4 including the actuator 5 can be assembled to the lower unit housing 103. In this configuration, it is possible to check the operation of the shift unit 4 by rotating the upper gear 41. Therefore, since the operation of the shift unit 4 can be checked without operating the engine 13, it is possible to improve an inspection environment. In addition, it is possible to produce the lower unit 903 as a separate single component.

Figure 7A:
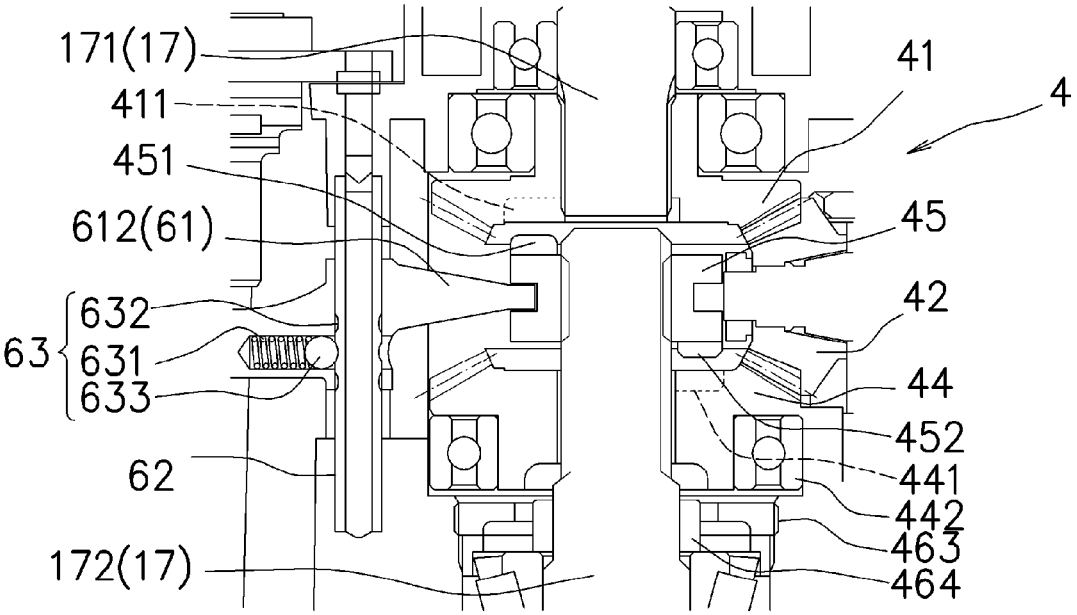
FIG. 7A is a cross-sectional view schematically illustrating operation of the shift unit, in which the shift position is set to a "neutral" position.
Figure 7B:
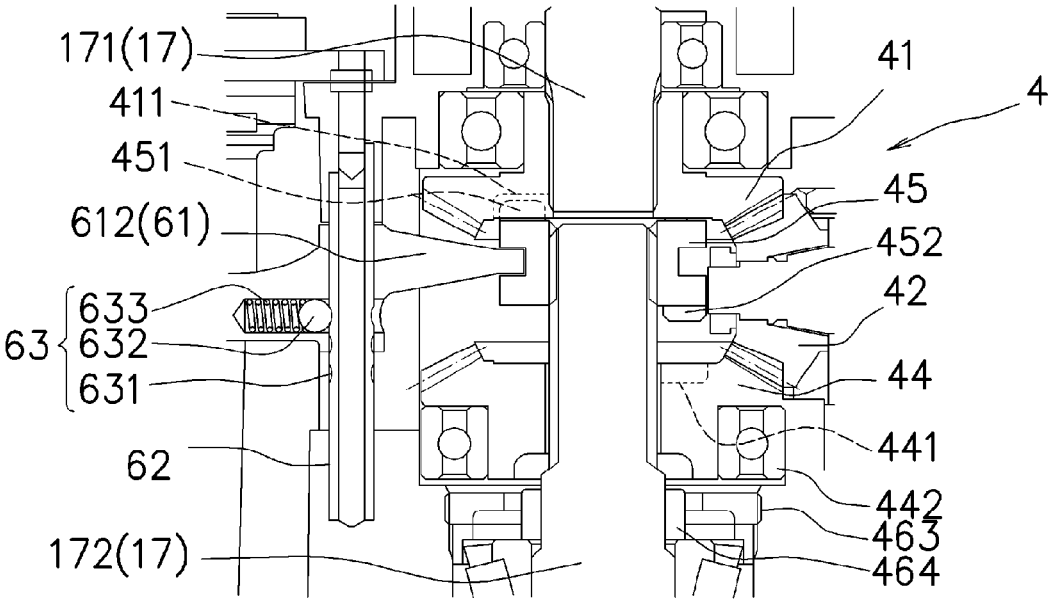
FIG. 7B is a cross-sectional view schematically illustrating operation of the shift unit, in which the shift position is set to a "forward" position.
Figure 7C:
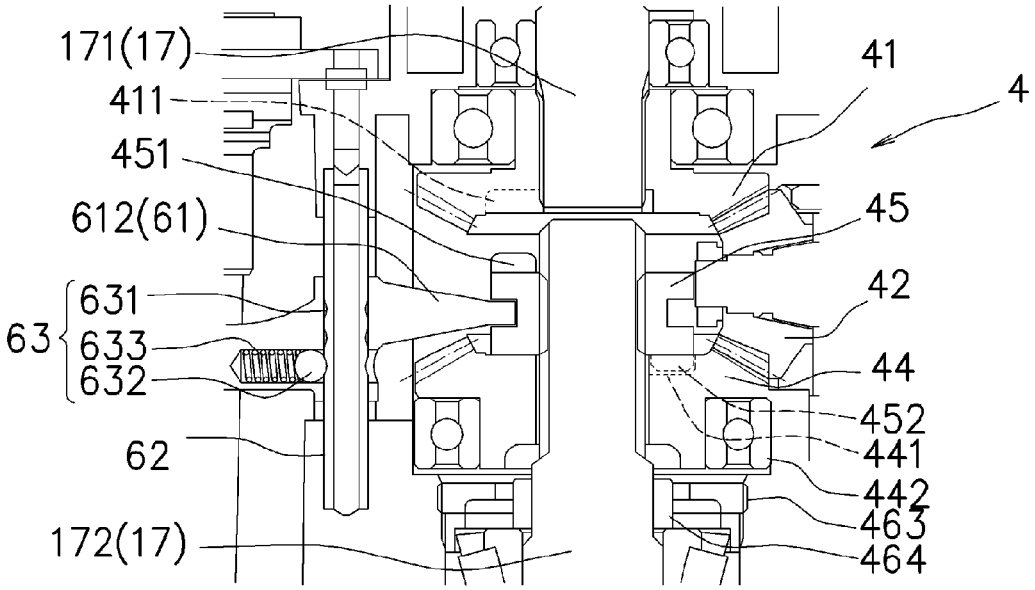
FIG. 7C is a cross-sectional view schematically illustrating operation of the shift unit, in which the shift position is set to a "backward" position.

Next, a description will be made for operations of the shift unit 4 with reference to FIGS. 7A to 7C. FIGS. 7A to 7C are cross-sectional views schematically illustrating operations of the shift unit 4. Specifically, FIG. 7A illustrates the operation when the shift position is in a neutral position, FIG. 7B illustrates the operation when the shift position is in a forward position, and FIG. 7C illustrates the operation when the shift position is in a backward position.

A ship operator operates the motor 51 by manipulating the actuator 5. As the motor 51 is operated, the rotational power of the motor 51 is transmitted to the ball screw mechanism 53 via the drive gear 510 and the intermediate gear 52, and the screw shaft 532 of the ball screw mechanism 53 makes a rectilinear motion upward or downward. The follower portion 613 of the shift fork member 61 is coupled to the screw shaft 532 of the ball screw mechanism 53, and the fork portion 612 of the shift fork member 61 is engaged with the dog clutch 45. For this reason, as the screw shaft 532 makes a rectilinear motion upward or downward, the dog clutch 45 is shifted upward or downward in response to the shift of the screw shaft 532.

As illustrated in FIG. 7A, when the dog clutch 45 is positioned in the middle of the vertical movable range, the upper ratchet 451 of the dog clutch 45 is not engaged with the catch 411 on the lower end surface of the upper gear 41, and the lower ratchet 452 is not engaged with the catch 441 on the upper end surface of the lower gear 44. In this case, the rotational power output from the engine 13 is not transmitted to the lower drive shaft 172. Therefore, the shift position becomes neutral.

As the dog clutch 45 is shifted upward as illustrated in FIG. 7B, the upper ratchet 451 of the dog clutch 45 is engaged with the catch 411 of the upper gear 41, and the dog clutch 45 is rotated in synchronization with the upper gear 41 and the upper drive shaft 171. As described above, the dog clutch 45 is provided to rotate in synchronization with the lower drive shaft 172. For this reason, in this state, the lower drive shaft 172 is rotated in synchronization with and in the same direction as the upper gear 41 and the upper drive shaft 171. In addition, the rotational power of the engine 13 is transmitted to the lower drive shaft 172 via the upper drive shaft 171, the upper gear 41, and the dog clutch 45. It is noted that, according to this embodiment, if the rotational power is transmitted from the upper gear 41 to the lower drive shaft 172 via the dog clutch 45 as illustrated in FIG. 7B, the shift position becomes "forward."

As the dog clutch 45 is shifted downward as illustrated in FIG. 7C, the lower ratchet 452 of the dog clutch 45 is engaged with the catch 441 on the upper end surface of the lower gear 44, so that the dog clutch 45 and the lower gear 44 are rotated in the same direction in an integrated manner. The rotational power is transmitted via the upper gear 41 and the intermediate gear 42, so that the lower gear 44 is rotated reversely to the upper gear 41. For this reason, the lower drive shaft 172 is rotated reversely to the upper gear 41 and the upper drive shaft 171. In this case, the rotational power of the engine 13 is transmitted to the lower drive shaft 172 via the upper drive shaft 171, the upper gear 41, the intermediate gear 42, the lower gear 44, and the dog clutch 45. According to this embodiment, in this state, the shift position becomes "backward."

The rotational power transmitted to the lower drive shaft 172 is further transmitted to the front and rear gears 21 and 22 from the pinion gear 18. The rotational power transmitted to the front gear 21 is transmitted to the rear propeller 12 via the inner shaft 231. The rotational power transmitted to the rear gear 22 is transmitted to the front propeller 11 via the outer shaft 232.

In this manner, according to this embodiment, the shift fork member 61 is shifted in parallel with the axial line of the drive shaft 17 by using the linear motion type actuator 5. In addition, the dog clutch 45 is shifted in parallel with the axial line of the drive shaft 17 by using the shift fork member 61. As a result, it is possible to switch the shift position to the "forward, "backward," and "neutral" positions.

It is noted that, when the shift position is in the "backward" position as described above, the rotational power of the engine 13 is transmitted to the lower drive shaft 172 via the upper gear 41, the intermediate gear 42, and the lower gear 44. Typically, when the shift position is in the "backward," the transmitted power is weaker, compared to the "forward" position. For this reason, it is possible to reduce strengths of the upper gear 41, the intermediate gear 42, and the lower gear 44. Therefore, it is possible to miniaturize the gears. As a result, it is possible to reduce the size and weight of the shift unit 4.

The shift unit 4 is provided with a position holding mechanism 63 for holding the shift position. The position holding mechanism 63 includes, for example, three engagement hollows 631 provided on the outer circumferential surface of the shift fork guide 62, an engagement member 632 provided in the shift fork member 61, and the biasing member 633. As the biasing member 633, for example, a compression coil spring is employed to bias and press the engagement member 632 to the outer circumferential surface of the shift fork guide 62. As the engagement member 632, for example, a steel ball and the like are employed. The engagement member 632 is fitted to any one of the three engagement hollows 631 formed on the outer circumferential surface of the shift fork guide 62 in each case where the shift position is set to "neutral," "forward," or "backward." It is noted that, although three engagement hollows 631 are provided in this embodiment, the invention is not limited thereto. For example, a single engagement hollow 631 engaged in the "neutral" position may be provided.

In this configuration, while an external force of the axial direction is not applied to the shift fork member 61, the engagement member 632 is held to be fitted to any one of the three engagement hollows 631 by virtue of the biasing force of the biasing member 633. For this reason, the shift position is held. In order to change the shift position, the actuator 5 applies a certain level of force to shift the screw shaft 532. Then, the engagement member 632 is extracted from the engagement hollow 631 resisting to the biasing force of the biasing member 633 as the shift fork member 61 is shifted. Therefore, it is possible to switch the shift position.

According to this embodiment, the actuator 5 is a linear motion type as described above, and the screw shaft 532 as a drive force output member makes a rectilinear motion. In addition, the rectilinear motion direction of the screw shaft 532 is in parallel with the shift direction of the dog clutch (the axial direction of the drive shaft 17). In this configuration, it is not necessary to change the direction of the drive force (rectilinear motion) generated by the actuator 5. For this reason, it is possible to simplify a configuration of the shift unit 4. In addition, if the direction of the drive force of the actuator 5 is changed, a deviation is generated during the change of the direction. In comparison, according to this embodiment, such a deviation is not generated, so that it is possible to perform accurate operation.

Furthermore, according to this embodiment, the shift amount of the dog clutch 45 becomes equal to the operation amount of the actuator 5. For this reason, the control of the operation of the dog clutch 45 becomes easy. In addition, since the stroke of the dog clutch 45 is the same between the forward shift position and the backward shift position, the operation amount of the actuator 5 also becomes equal. Therefore, it is possible to simplify the control of the actuator 5.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

The present invention relates to a technology suitable for an outboard motor having a shift unit. According to the present invention, it is possible to improve accuracy in the driving of the dog clutch and miniaturize the actuator.

According to the present invention, the actuator for driving the clutch body is installed in the lid member that covers the shift unit storage chamber. In this configuration, it is possible to facilitate assembly of the actuator and improve workability in assembling the shift unit.

What is claimed is:

1. An outboard motor comprising:

an upper unit where an engine is housed;

a lower unit that rotatably supports a propeller shaft where a propeller is installed;

a middle unit provided between the upper and lower units to house a part of a drive shaft that transmits rotational power from the engine to the propeller shaft; and a shift unit that switches a shift position, wherein the lower unit is provided with an upwardly opened shift unit storage chamber and a lid member that blocks an upper side of the shift unit storage chamber, the shift unit has a clutch body that switches the shift position by reciprocating in parallel with the drive shaft, a shift fork member engaged with the clutch body to reciprocate the clutch body in parallel with the drive shaft, and an actuator that reciprocates the shift fork member in parallel with the drive shaft, the shift unit is housed in the shift unit storage chamber, and the actuator is supported by the lid member.

2. The outboard motor according to claim 1, wherein the lid member is provided with a guide member that guides the shift fork member reciprocatingly in parallel with an axial line of the drive shaft.

3. The outboard motor according to claim 1, wherein the actuator is a linear motion type having a motor that generates rotational power, and a ball screw mechanism that has a ball screw nut and a screw shaft and converts rotational power generated from the motor into a rectilinear motion, and the shift fork member is connected by using the screw shaft and reciprocates the clutch in parallel with the drive shaft by a rectilinear motion of the screw shaft.

4. The outboard motor according to claim 1, wherein the lid member is provided with a bearing that rotatably supports the drive shaft.

* * * * *